US009061391B2

(12) United States Patent
Wittenborn

(10) Patent No.: US 9,061,391 B2
(45) Date of Patent: Jun. 23, 2015

(54) SHARPENER HOLDER

(71) Applicant: James W. Wittenborn, Aiken, SC (US)

(72) Inventor: James W. Wittenborn, Aiken, SC (US)

( * ) Notice: Subject to any disclaimer, the term of this patent is extended or adjusted under 35 U.S.C. 154(b) by 132 days.

(21) Appl. No.: 13/656,665

(22) Filed: Oct. 20, 2012

(65) Prior Publication Data

US 2014/0113529 A1 Apr. 24, 2014

(51) Int. Cl.
*B24B 3/36* (2006.01)
*B24B 41/06* (2012.01)

(52) U.S. Cl.
CPC ..... *B24B 3/36* (2013.01); *B24B 41/066* (2013.01)

(58) Field of Classification Search
CPC ..... B24B 3/36; B24B 3/368; B24B 3/54; B24B 19/002
USPC ..... 451/28, 45, 387, 555, 557, 558
See application file for complete search history.

(56) References Cited

U.S. PATENT DOCUMENTS

| | | | | | |
|---|---|---|---|---|---|
| 72,067 | A * | 12/1867 | Merritt | 451/112 |
| 845,487 | A * | 2/1907 | Strehl | 451/369 |
| 1,385,649 | A * | 7/1921 | Sherman | 451/224 |
| 4,450,653 | A * | 5/1984 | Fletcher | 451/552 |
| 4,936,053 | A * | 6/1990 | Shanelec | 451/224 |
| 5,090,160 | A * | 2/1992 | Paquette | 451/241 |
| 5,458,534 | A * | 10/1995 | Campione et al. | 451/555 |
| 5,462,476 | A | 10/1995 | Bohn | |
| 5,924,914 | A * | 7/1999 | Engh | 451/164 |
| 5,938,511 | A * | 8/1999 | Patterson | 451/377 |
| 6,168,509 | B1 | 1/2001 | Presgrove | |
| 6,254,455 | B1 * | 7/2001 | Irvine et al. | 451/28 |
| 6,623,340 | B2 * | 9/2003 | Jansson | 451/241 |
| 6,761,623 | B1 * | 7/2004 | Baker | 451/280 |
| 6,881,137 | B2 | 4/2005 | Friel, Sr. | |
| 7,387,562 | B1 * | 6/2008 | Blum | 451/45 |
| 7,413,504 | B2 * | 8/2008 | Lytinas | 451/67 |
| 7,467,991 | B2 * | 12/2008 | McCowen et al. | 451/349 |
| RE43,884 | E * | 1/2013 | Friel et al. | 76/81 |
| 8,951,098 | B2 * | 2/2015 | Jhones | 451/45 |
| 2006/0141916 | A1 * | 6/2006 | McCowen et al. | 451/349 |
| 2007/0026771 | A1 * | 2/2007 | Harden et al. | 451/45 |
| 2010/0203810 | A1 * | 8/2010 | Parrish | 451/45 |
| 2014/0099867 | A1 * | 4/2014 | Boelter | 451/45 |

* cited by examiner

*Primary Examiner* — George Nguyen
(74) *Attorney, Agent, or Firm* — Kenneth Buffington

(57) ABSTRACT

The sharpener holder is a device for sharpening blades of knives, scissors, axes, planes, chisels, and other cutting implements. The device accommodates any off-the-shelf sharpener rod whereas other sharpeners require the use of a unique or special rod built into the sharpener assembly. Most users already have sharpening rods, so all they have to do is put their existing sharpening rods into the sharpener holder to sharpen their knives or other cutting implements. The sharpener rod in the rod holder is securely clamped in position. The adjustable base is rotated to the required sharpening angle and securely clamped in position. The user moves the blade vertically against the sharpening rod at a perpendicular angle with respect to the base assembly to sharpen the blade.

17 Claims, 7 Drawing Sheets

N.T.S.

SHARPENER HOLDER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates generally to a device and method for sharpening blades and the like, and more specifically to a device and method for sharpening knives, scissors, axes, planes, chisels, and other cutting implements.

2. Background of the Invention

There are many patents related to blade sharpening devices indicating the wide scope of such inventions. Many of these devices could not sharpen blades to an accurate predetermined angle, and those that could require a particular manufacturer's sharpening stone or rod permanently affixed to the device. The present invention is adjustable to meet the angle of the particular knife or cutting implement being sharpened, and hold this angle consistently throughout the sharpening process. The present invention accommodates various types of, off-the-shelf sharpener rods and sticks from different manufacturers. Also, the present invention accommodates all different shapes of sharpener rods.

SUMMARY OF THE INVENTION

The present invention comprises a base assembly which serves as a foundation for mounting an adjustable base and sharpening rod holder. The sharpening rod holder (rod holder) accommodates most off-the-shelf sharpener (sharpening) rods. Most users already have sharpening rods, so all they have to do is put their existing sharpening rod into the sharpener to sharpen their knives or other cutting implements. The sharpener rod in the rod holder is securely clamped in position. The adjustable base is rotated to the required sharpening angle and securely clamped in position. To sharpen a blade, the user moves the blade vertically against the sharpening rod at a perpendicular angle with respect to the base assembly.

For purposes of the invention, sharpening rods or sharpening utensils include but are not limited to sharpening rods, sticks, stones, honers, etc. Sharpening rods also include but are not limited to various shapes and materials such as round, oblique, blunt end, tapered end, ceramic, diamond, and honed steel.

The knife or other cutting implement is not clamped in a fixed position as opposed to many other knife sharpeners which results in the removal of excessive amounts of material at the heel and tip of the knife. It not being clamped enables a consistent angle from tip to heel of the knife. The present invention maintains the same angle throughout the sharpening process for each knife or other cutting implement providing a consistent sharpness from tip to heel at the same angle and without removing excessive material. No other sharpener can do all of this.

BRIEF DESCRIPTION OF THE DRAWINGS

Referring now to the drawings in which like reference numbers represent corresponding parts throughout.

DESCRIPTION OF THE INVENTION

Figure 1:
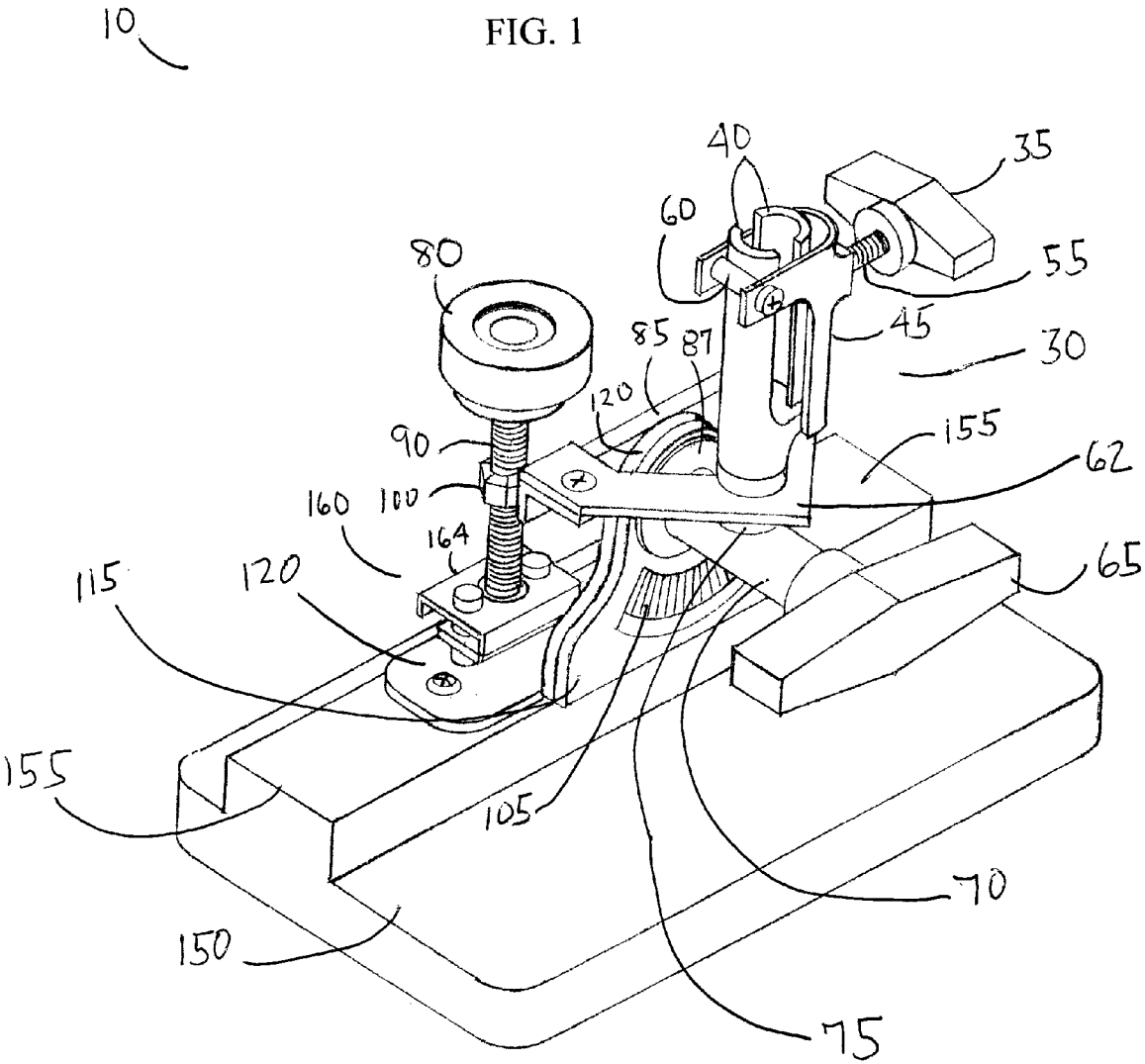
FIG. 1 is an assembled side perspective view of the sharpener holder according to a preferred embodiment of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the drawings, a sharpener holder, designated broadly at 10, is illustrated in FIGS. 1-7.

Referring to FIG. 1, the sharpener holder 10 of the present invention includes a receiver 30 which mounts a variety of single off-the-shelf sharpening rods 16 in a vertical upright position. The base assembly 150 comprises an elevated section 155 to accommodate full 360° rotation of the receiver base clamp 65. Adjustable knob bolt 90 threads through the adjustable knob receiver base locknut 100 to connect the adjustable knob 80 to the ball socket assembly 160. The adjustable knob 80 sets the receiver 30 with rod holder 40 to a predetermined angle for sharpening a blade. The receiver base clamp 65 securely locks in the predetermined angle so it will securely remain the same throughout the sharpening process.

Figure 2:
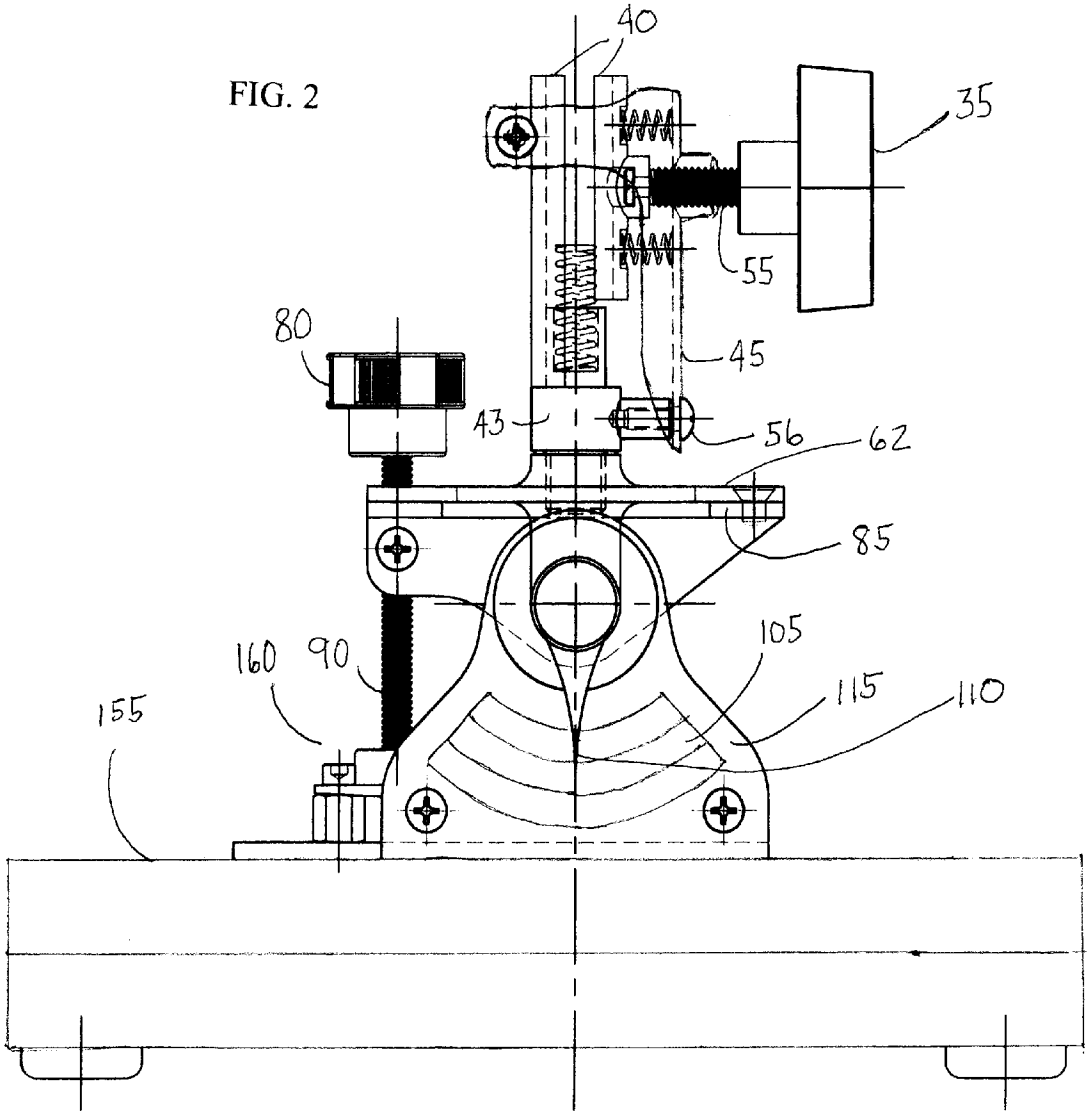
FIG. 2 is an assembled front perspective view of the sharpener holder according to a preferred embodiment of the present invention.
Figure 3:
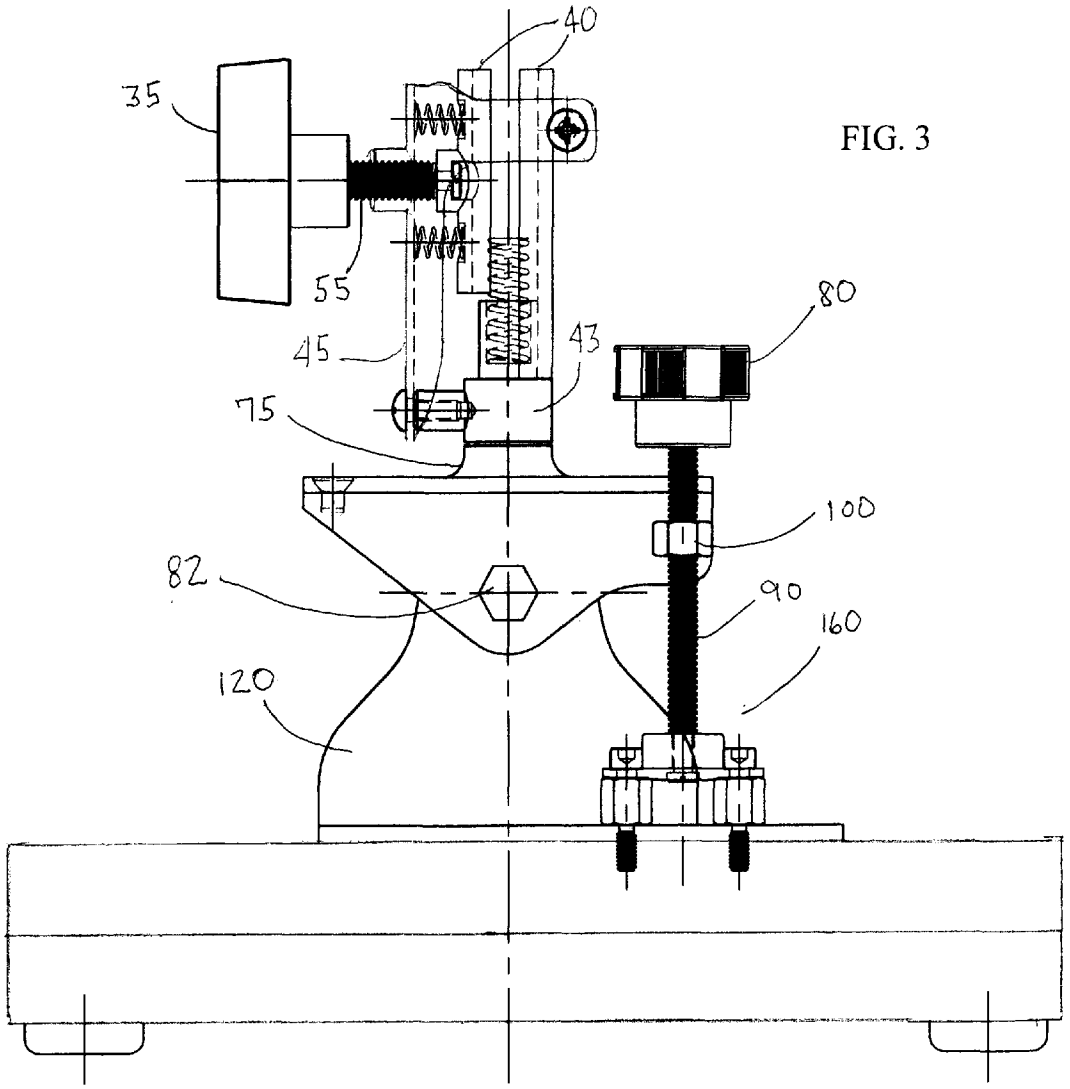
FIG. 3 is an assembled rear perspective view of the sharpener holder according to a preferred embodiment of the present invention.

As shown in FIGS. 1, 2, and 3, the adjustable swivel receiver base 62 is fastened to the adjustable swivel knob base 85 with bolts. The receiver base shaft 70 is fastened to the degree wheel faceplate 115 and adjustable swivel receiver pivot base 120 with a shaft bolt assembly 82. The shaft bolt 82 is attached to the receiver base clamp 65 on one end and adjustable knob base 85 on the other end. The degree wheel faceplate 115 and a spacer washer 87 is sandwiched between the adjustable swivel receiver pivot base 120 and the receiver base shaft 70. A degree wheel pointer 110 is attached to the receiver base shaft 70. Optionally, the degree wheel faceplate 115 is marked with indices 105 to display the inclination angle of receiver 30 with respect to the vertical point of reference. For example, a 0° inclination angle places the receiver 30 and the associated sharpening rod 16 in the vertical position which is perpendicular to the surface of the base assembly 150.

Figure 5:
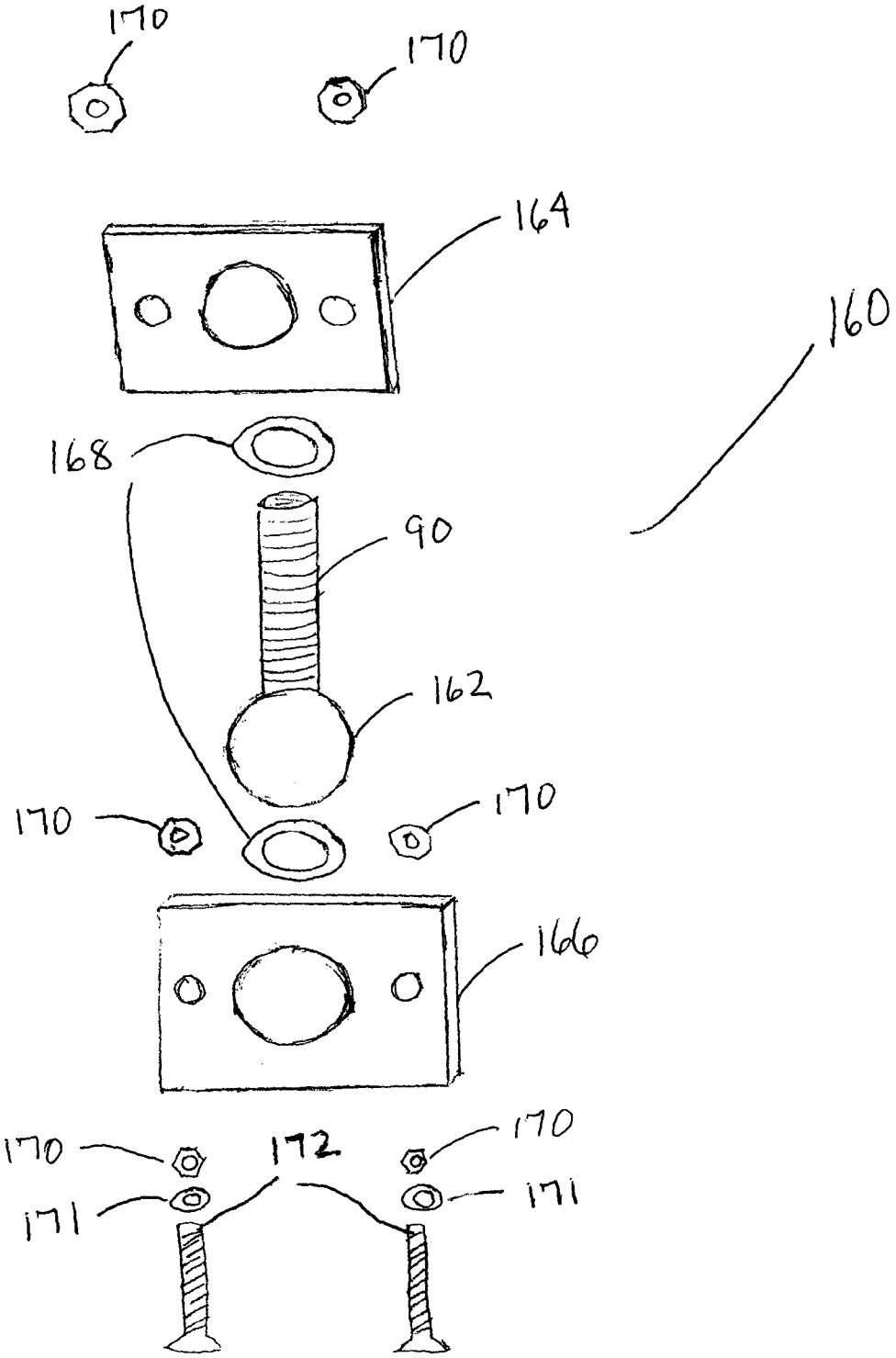
FIG. 5 is an exploded view of the ball socket assembly of the sharpener holder according to a preferred embodiment of the present invention.

As shown in FIGS. 1, 3, and 5, an adjustable knob receiver base locknut 100 is securely attached to the adjustable knob swivel base 85. Adjustable knob bolt 90 threads through the adjustable knob receiver base locknut 100 to connect the adjustable knob 80 to the ball socket assembly 160 so that the adjustable knob bolt 90 swivels along with the adjustable knob swivel base 85. The ball socket assembly 160 comprises a ball 162 securely attached to adjustable knob bolt 90 and an upper plate 164, a lower plate 166, two washers 168, six nuts 170, and two screws 172. The ball 162 is sandwiched between the upper plate 164 and the lower plate 166. The ball socket assembly 160 is securely attached to the elevated section by two screws 172 that pass through the bottom of the sharpener holder 10, two washers 171, and six 170 nuts. A washer 168 is placed on the top side of the lower plate and the bottom of the upper plate 164. The washers 168 make the adjusting action easier. The adjustable knob bolt 90 and adjustable knob receiver base locknut 100 serve to securely hold the inclination angle of the receiver 30 in a fixed position once it is set to the desired angle. Receiver base clamp 65 gets tightened and holds the receiver 30 in a fixed position.

Figure 4:
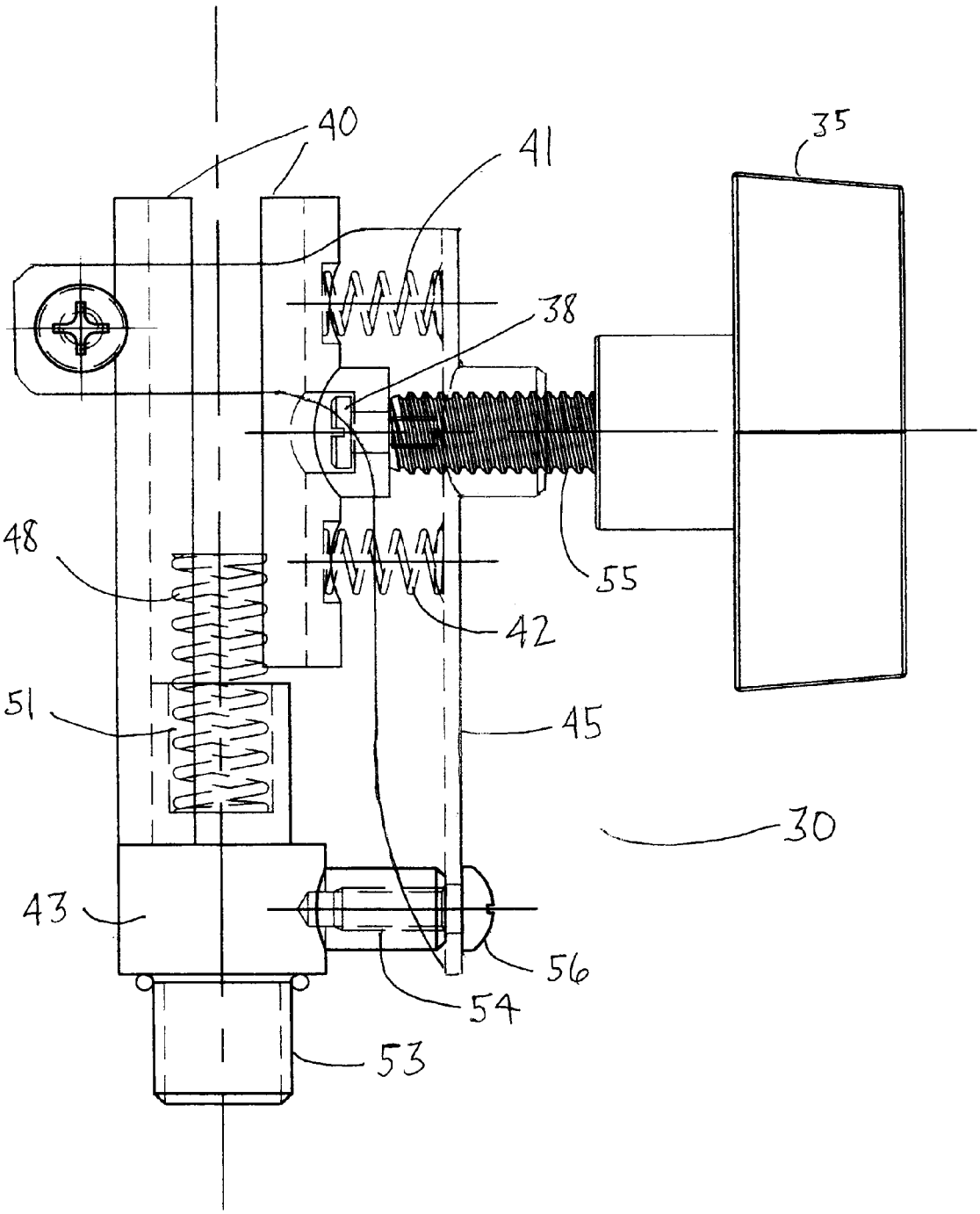
FIG. 4 is an assembled detailed view of the receiver of the sharpener holder according to a preferred embodiment of the present invention.

As shown in FIGS. 1 and 4, the receiver 30 comprises a receiver housing 45, rod holder 40, and adapter 43. The receiver housing 45 partially encloses the rod holder 40 which holds an off-the-shelf sharpening utensil. The receiver housing 45 attaches to the rod holder 40 on one side with a receiver clamp pin 60 and on the opposite side with a receiver clamp bolt 55. The receiver clamp bolt 55 attaches to a receiver clamp 35 and the rod holder 40. The receiver clamp bolt 55 is attached to the rod holder 40 with a universal swivel 38. The rod holder 40 includes two half cylindrical shells which form an opening which surrounds the sharpening rod 16. The two half cylindrical shells form an opening for the rod shaped portion of the sharpening rod 16. The diameter of the opening is adjusted by rotation of the receiver clamp 35. Two horizontal springs are mounted between the shorter half shell and the receiver housing 45. The horizontal springs 41, 42 transfer force from the receiver housing 45 to the shorter half shell which narrows the rod holder 40 opening.

As shown in FIGS. 1, 2, 3, and 4, the adapter 43 is an approximate T-shaped assembly which attaches the receiver 30 to the adjustable swivel receiver base 62. The adapter 30 includes a larger core 51 vertically on the upper end, a plug 53 vertically on the lower end, and a smaller core 54 horizontally on the side. The larger core 51 partially encloses a vertical spring 48 which rests at the bottom center of the rod holder. The vertical spring 48 provides an upward force to aid in the release and removal of the rod shaped portion of the sharpening rod 16 and to alleviate issues with tapered ends of rods 16. The plug 53 on the lower end of the adapter 43 is slightly less diameter than the diameter of the opening in the adjustable swivel receiver base 62 and the nipple 75 on the receiver base shaft 70. The plug 53 is threaded and snuggly inserts through the adjustable swivel receiver base 62 and into the mating threaded nipple 75 on the receiver base shaft 70 such that the receiver 30 is secured in place. The smaller core 54 is sized to accommodate a screw 56 which attaches the receiver housing 45 to the adapter 43.

In operation, loosen the receiver clamp 35 which will open the rod holder 40. Insert the desired sharpening utensil inside the rod holder 40 until it rests on the vertical spring 48. Tighten the receiver clamp 35 being careful not to over tighten. Loosen the receiver base clamp 65. Rotate the adjustable knob 80 to set the desired angle 23 to match the factory edge of the knife or other cutting implement 19 to be sharpened. The adjustable knob 80 tilts the adjustable swivel receiver base 62 thereby adjusting the angle 23 of the rod holder 40. The adjustable knob bolt 90 tilts alone with the adjustable swivel receiver base 62 since the adjustable knob receiver base lockout 100 is securely fastened to the adjustable swivel knob base 85. Once the angle 23 is set with the degree wheel pointer 110, tighten the receiver base clamp 65.

Figure 6:
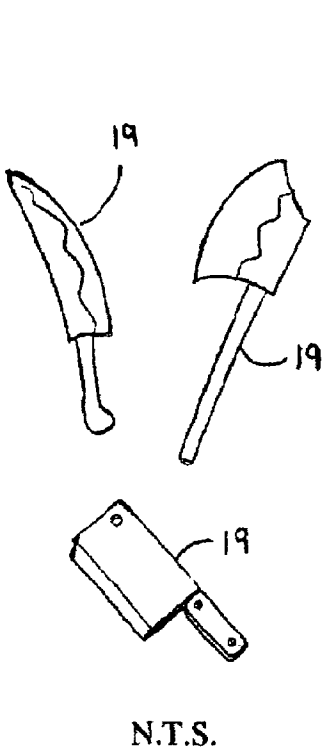
FIG. 6 is a side perspective view of the sharpener holder with sharpening utensil and cutting implements according to a preferred embodiment of the present invention.
Figure 6:
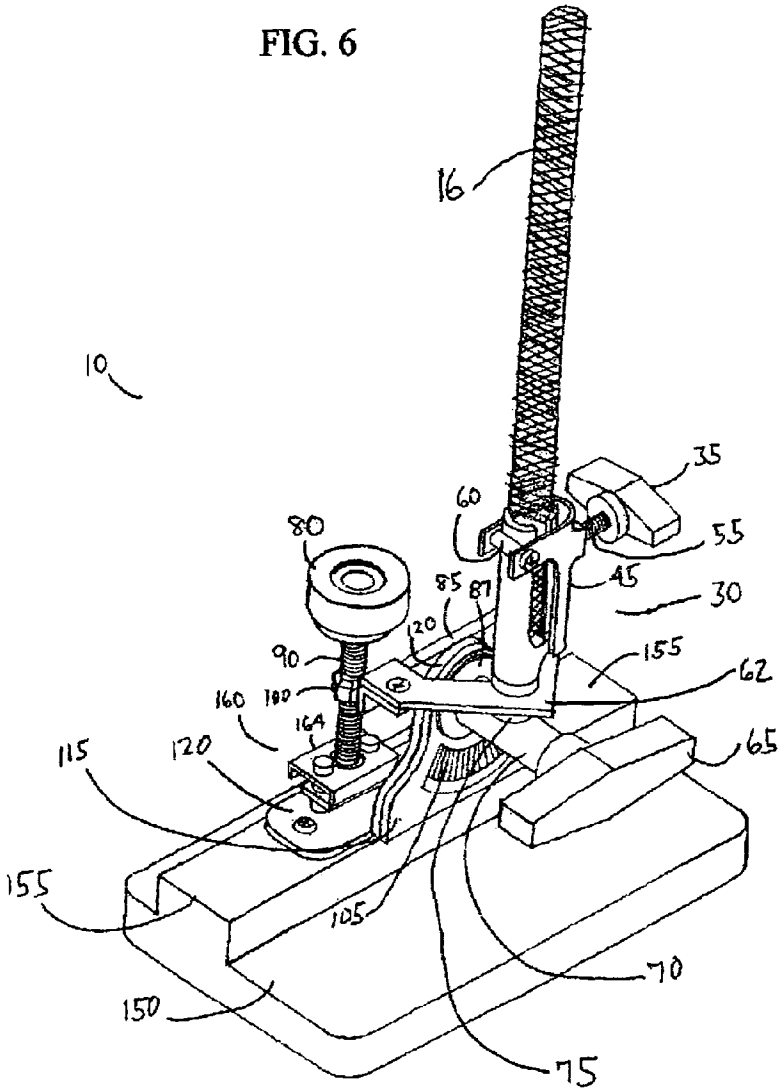
Figure 7:
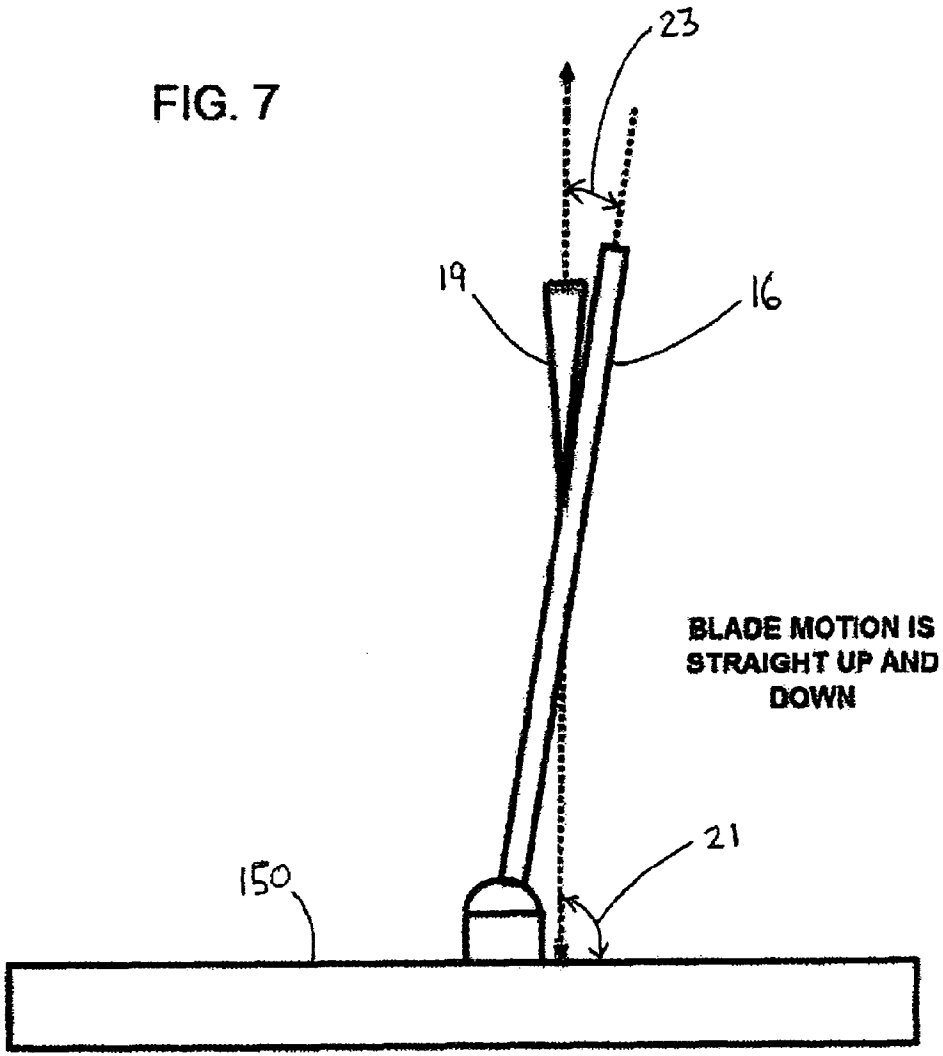
FIG. 7 is a detailed view of the sharpening utensil and cutting implement to illustrate the operation of the sharpener holder according to a preferred embodiment of the present invention.

As shown in FIGS. 6 and 7, hold the knife at a perpendicular angle 21 to the sharpener base 150 drawing the knife across (and down) the sharpener working from top to bottom (of the sharpener) from heel to tip of the knife. Keep the knife at the perpendicular angle 21 throughout the complete motion. Do several strokes on one side, then turn the base around 180° and then do several strokes on the other side of the knife blade. Repeat until the knife is sharp.

For dull or abused knives, the first time the knife sharpener is used for each knife start with a course sharpener rod 16 to true up the blade angle. Then change to finer sharpener rods 16 to improve the sharpness of the knife. To change sharpening utensils, loosen the receiver clamp 35, remove the sharpening utensil, insert a new sharpening utensil to the vertical spring 48 and tighten the receiver clamp 35 being careful not to over tighten. The angle 23 is already set and will remain the same throughout the sharpening process, regardless of shape, size, or material of different rods 16 used.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims.

I claim:

1. A device for sharpening cutting implements, said device comprising:

(a.) a base assembly;

(b.) a sharpening utensil;

(c.) a means for securely holding said sharpening utensil in a near vertical position;

(d.) a means for adjusting said sharpening utensil at a predetermined angle; and (e.) a means for securely locking said angle in a fixed position.

2. The device as claimed in claim 1, wherein said means for securely holding said sharpening utensil in a near vertical position comprises an adjustable opening to place said utensil and at least one adjustable clamp.

3. The device as claimed in claim 1, wherein said means for adjusting said sharpening utensil at a predetermined angle comprises a means of tilting said sharpening utensil.

4. The device as claimed in claim 3, wherein said means of tilting said sharpening utensil comprises an adjustable base, a receiver base clamp, and a ball socket assembly.

5. The device as claimed in claim 4, wherein said ball socket assembly comprises an adjustable knob.

6. The device as claimed in claim 5, wherein said adjustable knob connects to said adjustable base.

7. The device as claimed in claim 4, wherein said receiver base clamp connects to said adjustable base.

8. The device as claimed in claim 1, wherein said means for securely locking said angle in a fixed position comprises an adjustable base clamp.

9. The device as claimed in claim 1, wherein said sharpening utensil includes sharpening rods, sticks, stones, and honers.

10. The device as claimed in claim 1, wherein said cutting implements includes various shapes and materials such as round, oblique, blunt end, tapered end, ceramic, diamond, and honed steel.

11. The device as claimed in claim 1, wherein said cutting implements are not clamped in a fixed position.

12. A method for sharpening cutting implements, comprising:

(a.) providing a base assembly;
(b.) providing a sharpening utensil;
(c.) providing a means for securely holding said sharpening utensil in a near vertical position;
(d.) providing a means for adjusting said sharpening utensil at a predetermined angle;
(e.) providing a means for securely locking said angle in a fixed position;
(f.) holding a cutting implement at a perpendicular angle to the base assembly;
(g.) contacting the cutting implement with the sharpening utensil;
(h.) moving the cutting implement from top to bottom of the sharpening utensil from heel to tip of said implement for several strokes;
(i.) maintaining the cutting implement at said perpendicular angle throughout the movement;
(j.) rotating said base assembly 180°;
(k.) repeating steps (e) through (h) on the opposite side of the cutting implement blade until the desired sharpness is obtained.

13. The method as claimed in claim 12, wherein said cutting implements are not clamped in a fixed position.

14. A device for sharpening cutting implements, said device comprising:

(a.) a base assembly;
(b.) a sharpening utensil;
(c.) a receiver with an adjustable opening for securely holding said sharpening utensil in a near vertical position;
(d.) a receiver clamp for locking said sharpening utensil in place;
(e.) a ball socket assembly for adjusting said sharpening utensil at a predetermined angle; and
(f.) a receiver clamp for locking said predetermined angle in place.

15. The device as claimed in claim 14, wherein said cutting implements are not clamped in a fixed position.

16. The device as claimed in claim 14, wherein said sharpening utensil includes sharpening rods, sticks, stones, and honers.

17. The device as claimed in claim 14, wherein said cutting implements includes various shapes and materials such as round, oblique, blunt end, tapered end, ceramic, diamond, and honed steel.

* * * * *